US007578020B2

(12) United States Patent
Jaworski et al.

(10) Patent No.: US 7,578,020 B2
(45) **Date of Patent: *Aug. 25, 2009**

(54) SURFACE TREATING DEVICE WITH TOP LOAD CARTRIDGE-BASED CLEANING SYSTEM

(75) Inventors: Thomas Jaworski, Racine, WI (US); Jeffrey L. Harwig, New Berlin, WI (US); Mark M. Gipp, Racine, WI (US); Kathleen M. Laru, Racine, WI (US); Seakee Chen, Guangzhou, Guangdon Province (CN); Fukyuen Cheng, Ngau Tau Kok, Kowloon (HK); Kamfong Tam, Sai Wan Ho (HK)

(73) Assignee: S.C. Johnson & Son, Inc., Racine, WI (US)

( * ) Notice: Subject to any disclaimer, the term of this patent is extended or adjusted under 35 U.S.C. 154(b) by 687 days.

This patent is subject to a terminal disclaimer.

(21) Appl. No.: 11/168,898

(22) Filed: Jun. 28, 2005

(65) Prior Publication Data

US 2006/0288519 A1 Dec. 28, 2006

(51) Int. Cl.
*A47L 11/18* (2006.01)
*A47L 11/282* (2006.01)

(52) U.S. Cl. ..... 15/50.3; 15/50.1; 15/52.1; 15/98; 15/319

(58) Field of Classification Search ..... 15/41.1, 15/49.1, 50.1, 50.3, 40.3, 51, 52, 52.1, 98, 15/99, 319, 320
See application file for complete search history.

(56) References Cited

U.S. PATENT DOCUMENTS 1,278,606 A * 9/1918 Deam ..... 15/99
1,531,443 A * 3/1925 Johannessen ..... 15/51
1,536,687 A 5/1925 Oatey
1,619,313 A * 3/1927 Prince ..... 15/51
3,132,369 A * 5/1964 McMaster et al. ..... 401/46
3,583,818 A * 6/1971 Smyth et al. ..... 401/22
3,750,223 A * 8/1973 Leifheit ..... 15/50.3
4,119,900 A 10/1978 Kremnitz
4,433,451 A 2/1984 Parisi
4,510,642 A 4/1985 Ingermann et al.
4,550,467 A 11/1985 Johnson et al.
5,203,047 A 4/1993 Lynn
5,292,582 A 3/1994 Gibbs et al.
5,327,609 A 7/1994 Bierma et al.
5,636,402 A 6/1997 Kubo et al.
5,735,959 A 4/1998 Kubo et al.
5,815,880 A 10/1998 Nakanishi
5,896,611 A 4/1999 Haaga (Continued)

FOREIGN PATENT DOCUMENTS

DE 20116069 U1 12/2001

(Continued)

*Primary Examiner*—Mark Spisich

(57) ABSTRACT

A robotic surface treating device that can perform carpet sweeping, hard-surface dry sweeping/wiping, and hard-surface sweeping/mopping is disclosed. The robotic surface treating device includes a sweeper brush, a dust bin for collecting debris from the brush, a reel-to-reel sheet of cleaning material, and a fluid delivery system for delivering fluid from a fluid reservoir onto the sheet of cleaning material and/or onto the surface to be treated. The dust bin, reel-to-reel sheet of cleaning material, and the fluid reservoir are separately installed from the top of the device, and may be separately removed for replacement.

14 Claims, 6 Drawing Sheets

U.S. PATENT DOCUMENTS

| | | | | |
|---|---|---|---|---|
| 5,933,900 | A | 8/1999 | Wang | |
| 5,940,928 | A | 8/1999 | Erko | |
| 5,991,951 | A * | 11/1999 | Kubo et al. | 15/50.1 |
| 6,105,192 | A | 8/2000 | Deiterman et al. | |
| 6,112,996 | A | 9/2000 | Matsuo | |
| 6,301,738 | B1 | 10/2001 | Deiterman et al. | |
| 6,311,356 | B1 | 11/2001 | Wang | |
| 6,324,714 | B1 | 12/2001 | Walz et al. | |
| 6,459,955 | B1 | 10/2002 | Bartsch et al. | |
| 6,481,515 | B1 | 11/2002 | Kirkpatrick et al. | |
| 6,594,844 | B2 | 7/2003 | Jones | |
| 6,741,054 | B2 | 5/2004 | Koselka et al. | |
| 6,809,490 | B2 | 10/2004 | Jones et al. | |
| 2002/0011813 | A1 | 1/2002 | Koselka et al. | |
| 2003/0159223 | A1 * | 8/2003 | Plankenhorn | 15/52.1 |
| 2004/0244138 | A1 | 12/2004 | Taylor et al. | |
| 2005/0217042 | A1 * | 10/2005 | Reindle | 15/41.1 |

FOREIGN PATENT DOCUMENTS

| | | | |
|---|---|---|---|
| GB | 2404139 | A | 1/2005 |
| GB | 2409966 | A | 7/2005 |
| WO | WO 01/82766 | A2 | 11/2001 |
| WO | WO 2005/077244 | A1 | 8/2005 |

* cited by examiner

SURFACE TREATING DEVICE WITH TOP LOAD CARTRIDGE-BASED CLEANING SYSTEM

CROSS REFERENCES TO RELATED APPLICATIONS

Not applicable

STATEMENT REGARDING FEDERALLY SPONSORED RESEARCH/DEVELOPMENT

Not applicable

BACKGROUND OF THE INVENTION

It is desirable to minimize the amount of human labor expended in maintaining and cleaning residential and commercial spaces. The art has therefore developed robotic devices that can clean or otherwise maintain or treat floors, carpeting or the like without the necessity for a human to be present during the operation of the device. The most common robotic devices of this kind are dusters, buffers, vacuum cleaners, floor sweepers, and floor polishers.

Such devices typically have a computer control program to direct a preferred movement pattern. The control is linked to steering devices as well as motors that are in turn connected to wheels. Many of these devices also include sensors to confirm the initial and later positions of the device relative to the pre-set path. The most sophisticated of these devices include sensors to detect the presence of unexpected obstacles, as well as programming to provide options for altered paths where that occurs. Examples of a prior art control system for such a robotic system are disclosed in U.S. Pat. Nos. 4,119,900 and 6,594,844.

As these devices are intended to be operated autonomously, and for a significant period of time, it is desirable to provide a supply of cleaning materials which is renewable and which does not require significant maintenance. It is also desirable that various types of cleaning supplies for various types of cleaning and floor surfaces can also be provided, in order to provide multiple cleaning functions from a single device. Various types of cleaning should not only be available, but easily implemented on the autonomous cleaning device.

Known in the art are various methods for providing a length of cleaning material in a reel to reel configuration. U.S. Pat. No. 4,433,451, for example, depicts a floor cleaning device which is designed to have a reel-to-reel cloth that is advanced during use. The cloth is used for cleaning and/or drying the floor, and may be a non-woven fabric. An elastic compression element forces the cloth towards the floor. The system is described as also being capable of delivering liquid. Another such system is disclosed in U.S. Pat. No. 4,510,642 which describes the use of a mechanism for tightening a dusting cloth in a reel-to-reel system used for one type of flooring, here a bowling lane. Yet another system is disclosed in U.S. patent application 2002/0011813 which describes an autonomous floor mopping apparatus including premoistened toweling that transfers between a feed roller and a take-up roller wherein the toweling is pressed against the floor to clean the floor.

Also known in the art are certain removable cleaning elements. U.S. Pat. No. 5,933,900, for example, discloses a floor cleaning machine which can include a removable dust pan. U.S. patent application Ser. No. 11/051,312, filed Feb. 4, 2005, which is assigned to the assignee of the present application, discloses a cartridge including a reel-to-reel roll of cleaning material for use in a robotic cleaning device. The cartridge provides either an electrostatic dust cloth or wet mop, and includes a fluid reservoir for keeping the cloth wet during use. A dust bin is also provided on the cartridge, and includes a hinged lid for providing selective access to the dust inside of the bin. A motor, optical sensor, and fluid pump inside of a cleaning apparatus control the operation of the reel-to-reel cloth, and control fluid delivery to the wet cloth.

What is lacking in the art is a robotic surface treating device where a dust bin, a fluid reservoir, and a reel-to-reel cartridge of cleaning material are each separately provided on the surface treating device, and once these devices are installed, they may be separately replaced when, for example, the dust bin is full, the fluid is used-up, or the cleaning cloth material is either used-up or soiled to the point of inefficiency. The present invention addresses this need.

BRIEF SUMMARY OF THE INVENTION

The invention provides a robotic surface treating device including as separate components: (i) a dust bin, (ii) a fluid reservoir, and (iii) a reel-to-reel roller-based cleaning cartridge of sheet cleaning material, which are each provided on the surface treating device and, once these components are installed they may be individually removed and separately replaced.

In one aspect, the invention provides a robotic surface treating device including a dust bin, a sheet of cleaning material, means for moving the sheet of cleaning material relative to a surface to be treated, and a housing including a compartment having an open end for separately removably receiving the dust bin and the sheet of cleaning material. In one configuration of the robotic surface treating device, the open end of the compartment faces upward when the device is placed on the surface to be treated. This allows a user to easily load the dust bin and the sheet of cleaning material in the top of the robotic surface treating device.

The robotic surface treating device may further include a fluid delivery system including a fluid reservoir. The open end of the compartment also separately removably receives the fluid reservoir. This allows a user to easily load the fluid reservoir in the top of the robotic surface treating device. The fluid delivery system may include a pump for delivering fluid from the fluid reservoir onto the sheet of cleaning material and/or the surface to be treated. The robotic surface treating device may include a wheel, means for measuring rotation of the wheel, and a controller in communication with the pump and the means for measuring rotation of the wheel. The controller provides fluid delivery signals to the pump such that fluid is not delivered onto the sheet of cleaning material and/or the surface to be treated when the rotation of the wheel is less than a predetermined amount. As a result, fluid delivery is prevented when the robotic surface treating device is stopped or moving slowly.

In one configuration, the means for moving the sheet of cleaning material includes a first roller suitable for letting out a roll of the sheet of cleaning material, a second roller suitable for reeling in the sheet of cleaning material, and a motor to cause the sheet of cleaning material to transfer between the first roller and the second roller. The means for moving the sheet of cleaning material may also include a sensor for monitoring the amount of the sheet cleaning material let out by the first roller. The sensor provides feedback signals to the motor such that the amount of cleaning material transferred between the first roller and the second roller is controlled.

The means for moving the sheet of cleaning material may also include a cartridge for mounting the first roller and the second roller, and the open end of the compartment is dimensioned to separately removably receive the cartridge. The means for moving the sheet of cleaning material may also include a window for viewing the sheet of cleaning material in the cartridge. This allows a user to check to see when the sheet of cleaning material is used up and needs to be replaced. The means for moving the sheet of cleaning material may also include a platen for pressing the sheet of cleaning material against the surface being treated. This provides improved cleaning performance.

When the means for moving the sheet of cleaning material includes a cartridge for mounting the first roller and the second roller, the cartridge may be pivotally connected to the housing at a first end of the cartridge such that a second opposite end of the cartridge can move up and down when encountering changes in elevation in the surface being treated. Alternatively, the cartridge may be connected to the housing such that the cartridge can be positioned in an up position or in a down position. When a user does not wish to use the sheet of cleaning material on the surface being treated, the cartridge can be positioned in an up position. The means for moving the sheet of cleaning material may include a level sensor for sensing changes in elevation in the surface being treated and means for moving the cartridge into the up or the down position in response to signals from the level sensor.

The dust bin may include a flexible blade that is provided adjacent the dust bin and directed toward the dust bin to direct dirt into the dust bin from a sweeper brush coupled to the housing. The dust bin may also include a spring loaded door that closes over an opening in the dust bin when the dust bin is removed from the housing. The dust bin may further include means for removably securing the dust bin to the housing. In one configuration, the means for removably securing the dust bin to the housing includes a button at the top of a dust bin handle that can be pushed to retract a set of spring-loaded latching pins. When the latching pins are retracted, the dust bin may be removed from the housing. When the dust bin is in its fully installed/latched position, the handle can serve as a carrying handle for the robotic surface cleaning device.

In another aspect, the invention provides a robotic surface treating device including a fluid delivery system including a fluid reservoir, a sheet of cleaning material, means for moving the sheet of cleaning material relative to a surface to be treated, and a housing including a compartment having an open end for separately removably receiving the sheet of cleaning material and the fluid reservoir. This aspect of the invention would be useful in environments where a dust bin and a sweeper brush are not desired. In one configuration of this version of the robotic surface treating device, the open end of the compartment faces upward when the device is placed on the surface to be treated. This allows a user to easily load the fluid reservoir and the sheet of cleaning material in the top of the robotic surface treating device.

In this aspect of the invention, the fluid delivery system may include a pump for delivering fluid from the fluid reservoir onto the sheet of cleaning material or the surface to be treated. The robotic surface treating device may include a wheel, means for measuring rotation of the wheel, and a controller in communication with the pump and the means for measuring rotation of the wheel. The controller provides fluid delivery signals to the pump such that fluid is not delivered onto the sheet of cleaning material and/or the surface to be treated when the rotation of the wheel is less than a predetermined amount.

As a result, fluid delivery is prevented when the robotic surface treating device is stopped or moving slowly.

In this aspect of the invention, the means for moving the sheet of cleaning material includes a first roller suitable for letting out a roll of the sheet of cleaning material, a second roller suitable for reeling in the sheet of cleaning material, and a motor to cause the sheet of cleaning material to transfer between the first roller and the second roller. The means for moving the sheet of cleaning material may also include a sensor for monitoring the amount of the sheet cleaning material let out by the first roller. The sensor provides feedback signals to the motor such that the amount of cleaning material transferred between the first roller and the second roller is controlled.

In this aspect of the invention, the means for moving the sheet of cleaning material may also include a cartridge for mounting the first roller and the second roller, and the open end of the compartment is dimensioned to separately removably receive the cartridge. The means for moving the sheet of cleaning material may also include a window for viewing the sheet of cleaning material in the cartridge. This allows a user to check to see when the sheet of cleaning material is soiled and needs to be replaced. The means for moving the sheet of cleaning material may also include a platen for pressing the sheet of cleaning material against the surface being treated. This provides improved cleaning performance.

The cartridge may be pivotally connected to the housing at a first end of the cartridge such that a second opposite end of the cartridge can move up and down when encountering changes in elevation in the surface being treated. Alternatively, the cartridge may be connected to the housing such that the cartridge can be positioned in an up position or in a down position. When a user does not wish to use the sheet of cleaning material on the surface being treated, the cartridge can be positioned in an up position.

The means for moving the sheet of cleaning material may include a level sensor for sensing changes in elevation in the surface being treated and means for moving the cartridge into the up or the down position in response to signals from the level sensor.

The foregoing and other advantages of the invention will become apparent from the following description. In the following description reference is made to the accompanying drawings which form a part thereof, and in which there is shown by way of illustration preferred embodiments of the invention. These embodiments do not represent the full scope of the invention. Reference should therefore be made to the claims herein for interpreting the scope of the invention.

DETAILED DESCRIPTION OF THE PREFERRED EMBODIMENTS

Figure 1:
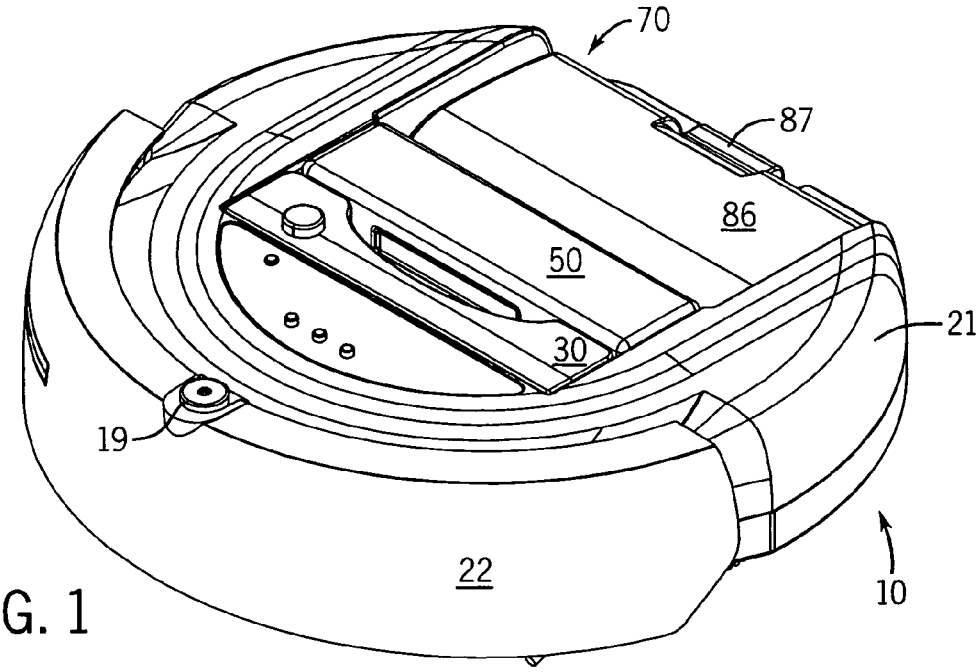
FIG. 1 is a top, front, right perspective view of an autonomous robotic surface treating device of the present invention.
Figure 2:
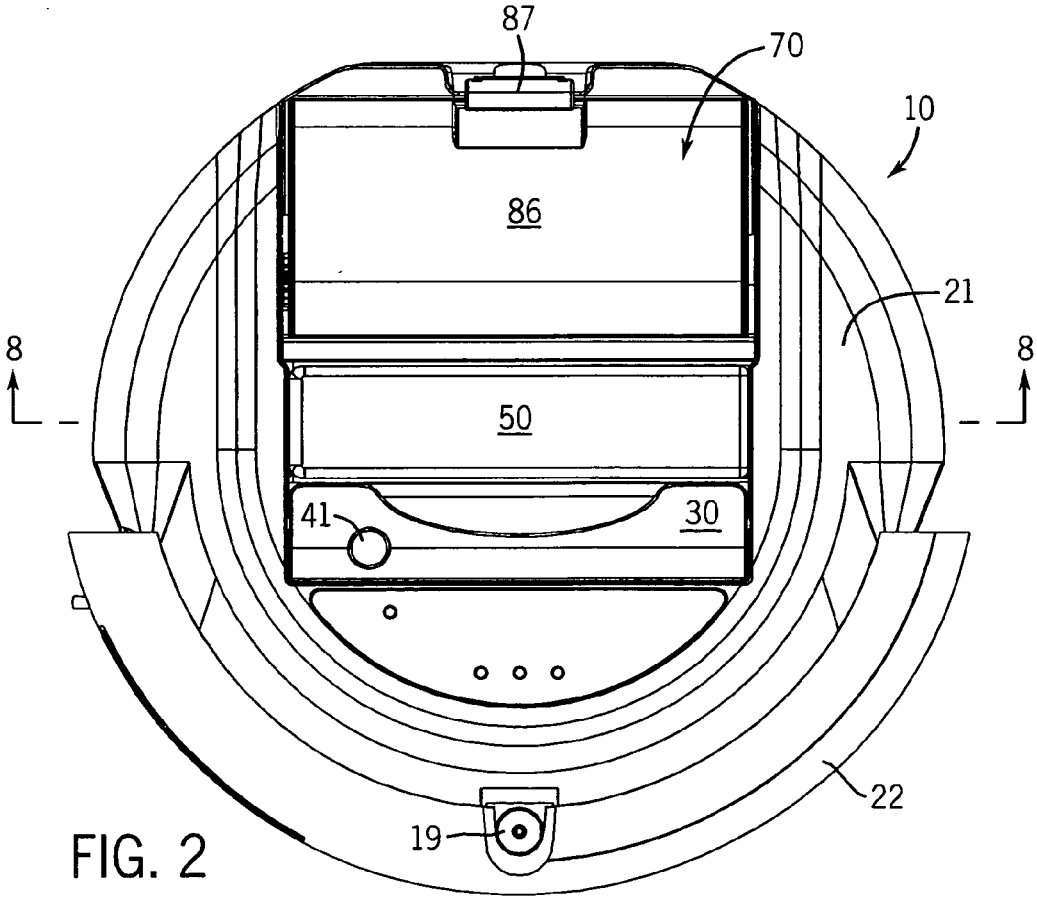
FIG. 2 is a top plan view of the device of FIG. 1.

Referring to FIGS. 1-9, there is shown an autonomous robotic surface treating device 10 according to the invention. The robotic surface treating device 10 includes a housing 11 that supports a right wheel 12, a right wheel motor 13, a left wheel 14, a left wheel motor 15, a front center wheel 16, a top cover 21, and a bumper 22. The right wheel motor 13 and the left wheel motor 15 receive power from a bank of batteries 18 (see FIG. 8), and are under the control of a programmable controller (not shown).

An encoder may be associated with each wheel 12,14 and each encoder is connected to the controller. Encoders are commercially available and in one version, the encoder outputs a signal having a pulse every time each wheel 12,14 rotates a predetermined angle. The controller respectively calculates the wheel speed of each wheel 12,14 based upon an interval between pulses outputted from each encoder. Among other things, the controller can use calculated wheel speeds to control motion of the right wheel 12 and the left wheel 14. In one example algorithm, the controller provides a positive voltage in the range of 0 to +10 volts to each motor 13 and 15 to drive the right wheel 12 and the left wheel 14 in forward motion. Voltage controls the motor speed as voltage will typically be proportional to motor speed. The controller provides a negative voltage in the range of 0 to −10 volts to each motor 13 and 15 to drive the right wheel 12 and the left wheel 14 in reverse motion.

When the robotic surface treating device 10 is placed on the floor 84 (see FIG. 8) of the room to be cleaned, an activation switch 19 is pressed to activate the navigational system for directing the robotic surface treating device 10 about the floor 84 of the room to be cleaned for a predetermined time period (e.g., sixty minutes). The program in the controller may begin directing the robotic surface treating device 10 about the floor 84 using any number of known behaviors.

U.S. Pat. No. 6,809,490, which is incorporated herein by reference along with all other documents cited herein, describes various modes in which the robotic surface treating device 10 may operate. For example, the robotic surface treating device 10 may operate in spiral behavior in which the program provides for outward spiral movement generated by increasing the turning radius of the robotic surface treating device 10 as a function of time. Alternatively, the robotic surface treating device 10 may operate in straight line behavior. Also, the robotic surface treating device 10 may operate in wall-following behavior wherein the robotic surface treating device 10 uses a wall-following sensor to position itself a set distance from a wall and proceeds to travel along the perimeter of the wall. Also, the robotic surface treating device 10 may operate in bounce behavior in which the robotic surface treating device 10 travels until a bump sensor in bumper 22 is activated by contact with an obstacle. Any combination of these or other behaviors may be programmed in the controller.

Figure 5:
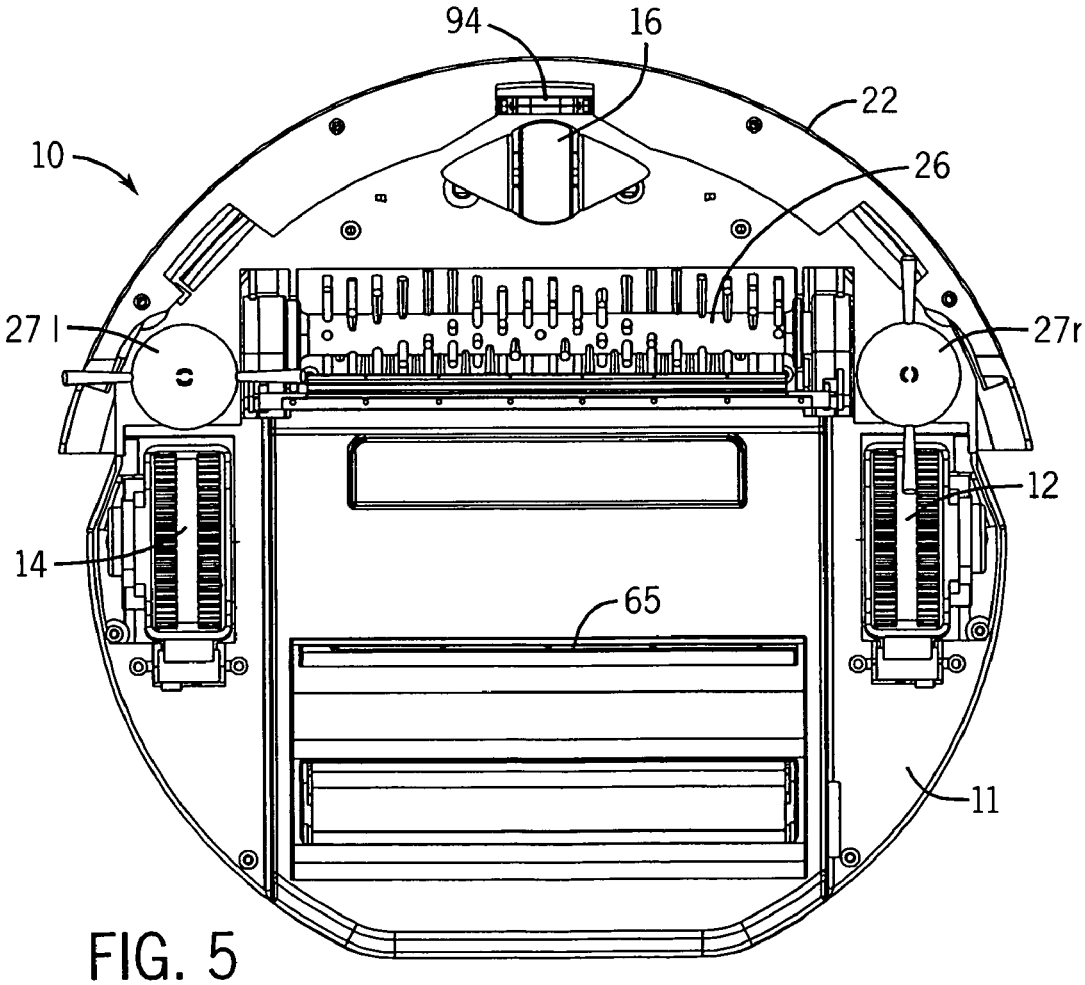
FIG. 5 is a bottom plan view of the device of FIG. 1.

Referring to FIG. 5, the robotic surface treating device 10 includes a left side brush 27*l*, a right side brush 27*r* and a removable/replaceable central roller sweeper brush 26 for cleaning large particulate matter on the surface being cleaned. Thus, a sweeping function is accomplished by the robotic surface treating device 10 using the roller brush 26 and the two side cleaning brushes 27*l*, 27*r*. The side brushes 27*l*, 27*r* allow for cleaning beyond the edges of the robotic surface treating device 10 itself. The side brushes 27*l*, 27*r* feed floor debris inward to the roller brush 26. The roller brush 26 then sweeps large debris into a dust bin 30 as described below.

The roller brush 26 is removable by the consumer for the following purposes: (1) to enable easier cleaning of hair, fiber, and other debris from the brush, (2) to enable easier cleaning of the underside of the brush housing, (3) to enable replacement of the brush due to excess wear/degradation, and (4) to allow alternate brush types for optimized cleaning performance for various specific cleaning tasks. The roller brush 26, side brushes 27*l*, 27*r*, and drive motors 13, 15 are all assembled on a pivot mechanism which allows the brush assembly to self-level. This is particularly important when moving from hard surface to carpet sweeping, over area rugs, and transitions. Typically vacuum cleaners use manual height adjustment levers to raise and lower the effective brush height. In addition to sweeping, the roller brush 26 and side brushes 27*l*, 27*r* may be used to provide scrubbing action, particularly in a wet cleaning mode. Optionally, vacuum may be added to the robotic surface treating device 10 to further improve debris pick-up or to improve ability to clean along edges and corners.

Figure 3:
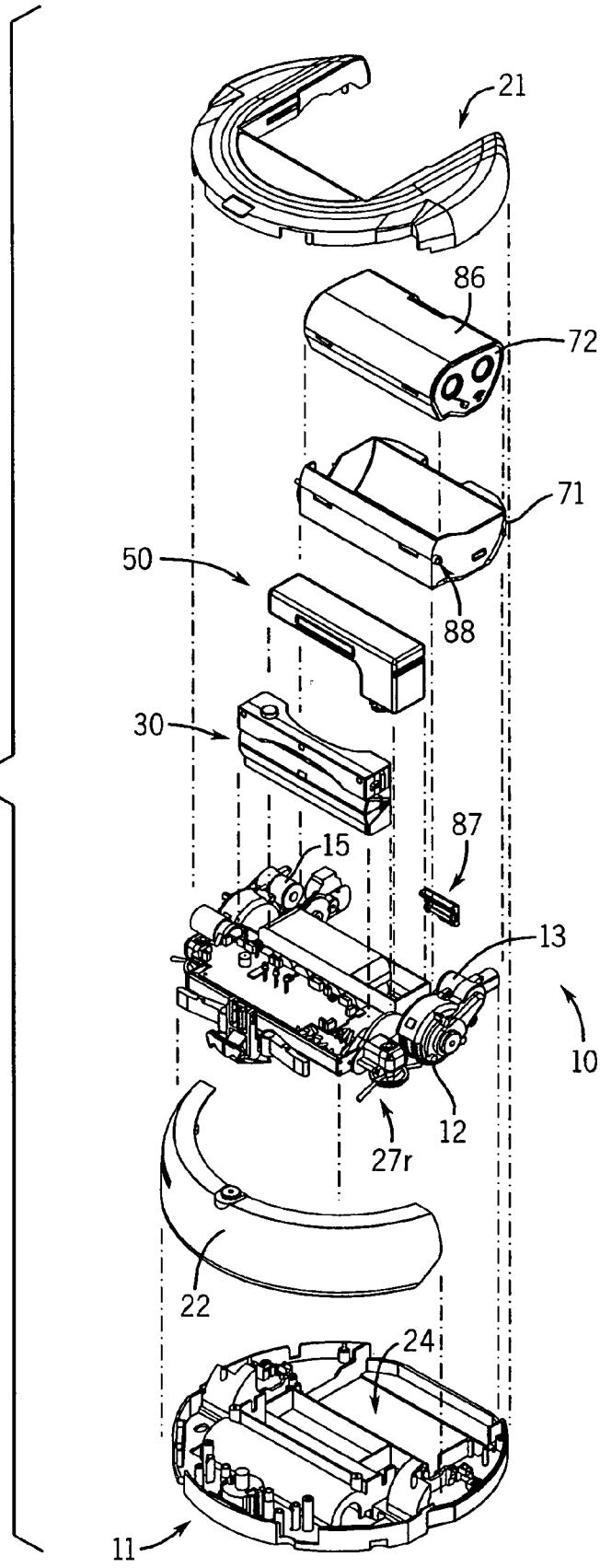
FIG. 3 is top, front, right exploded perspective view of the device of FIG. 1.
Figure 4:
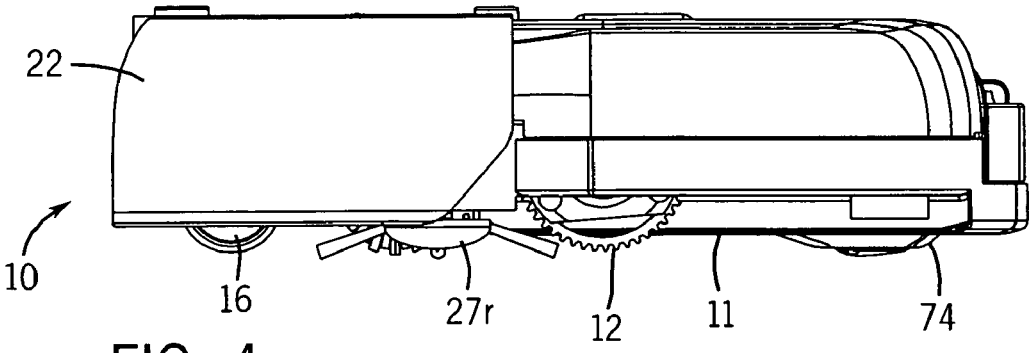
FIG. 4 is a right side elevational view of the device of FIG. 1.
Figure 6:
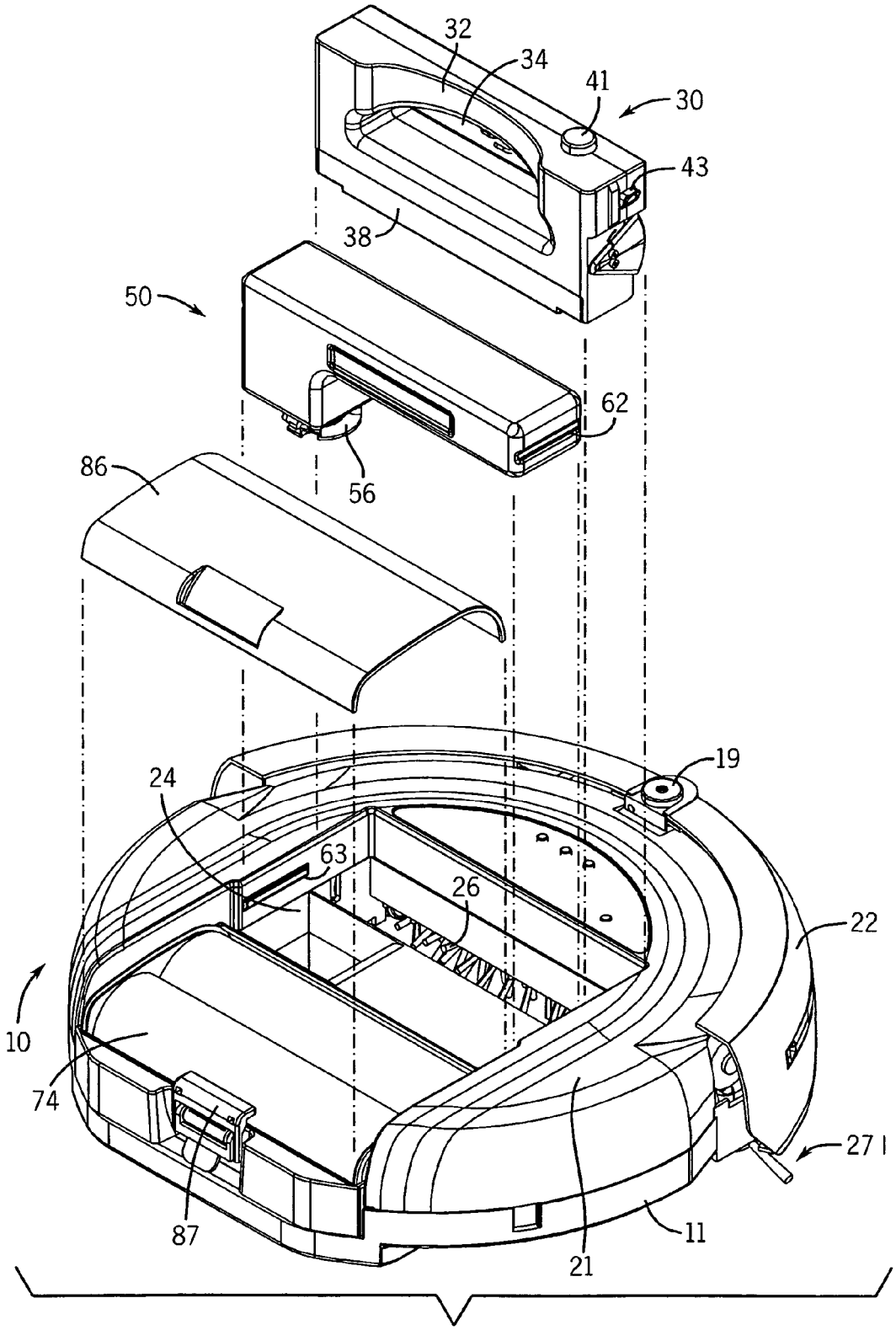
FIG. 6 is top, rear, left exploded perspective view of the device of FIG. 1.
Figure 9:
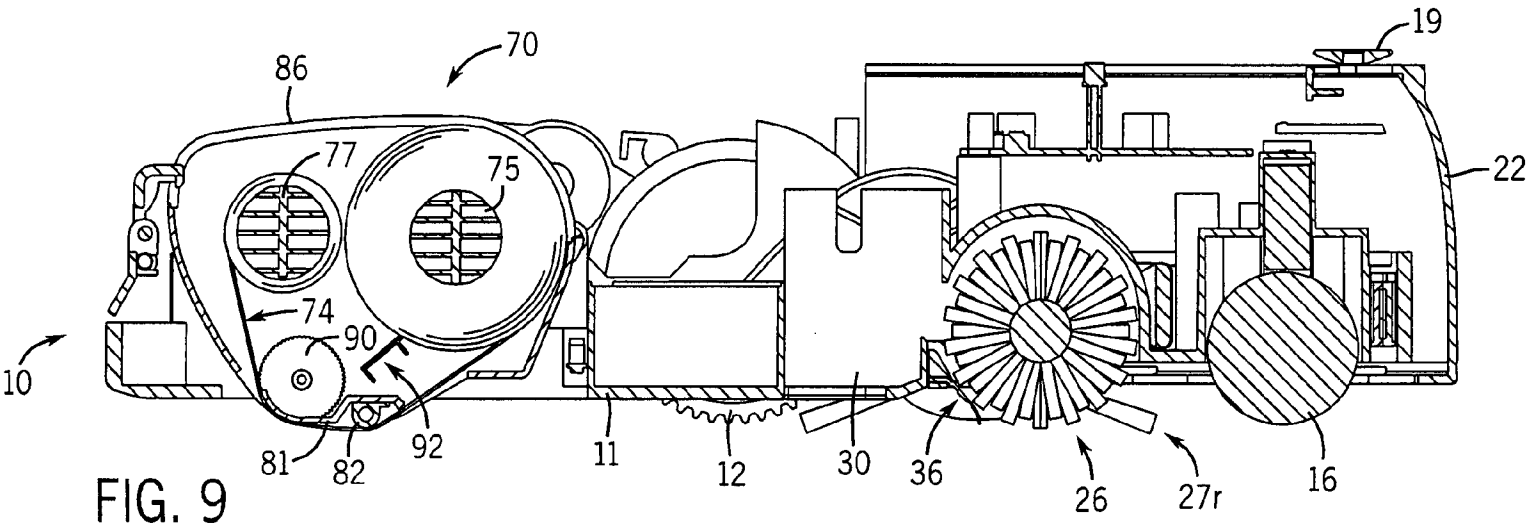
FIG. 9 is a sectional view taken along line 9-9 of FIG. 7.

Looking at FIGS. 3, 6 and 9, there is provided a compartment 24 in the housing 11 of the robotic surface treating device 10. The compartment 24 has an open end that faces upwardly when the robotic surface treating device 10 is placed on the floor 84. The compartment 24 is dimensioned for receiving a removable, replaceable dust bin 30. The dust bin 30 is designed to be positioned behind the sweeper brush 26 in the front of the compartment 24 of the robotic surface treating device 10. The dust bin 30 is selectively covered by a hinged door 38, which is forced open as the dust bin 30 is moved into the compartment 24 but which swings shut and is therefore normally closed when the dust bin 30 is removed from the robotic surface treating device 10, thereby retaining dust collected by the robotic surface treating device 10 within the dust bin 30 for cleaning, replacement, or disposal of the dust bin 30. A flexible blade 36 (see FIG. 9) is provided in front of the dust bin 30, directed from an upper edge of the dust bin 30 to the surface below the robotic surface treating device 10. The flexible blade 36 directs dirt collected by the sweeper brush 26 of the robotic surface treating device 10 into the dust bin 30.

Looking at FIG. 6, the top portion of the dust bin 30 includes a handle 32 with a recessed area 34 for fingers for grasping by the user. A button 41 at the top of the handle 32 can be pushed to retract a set of spring-loaded latching pins 43 which engage a recess in the inner wall of the compartment 24 when the dust bin 30 is installed in the robotic surface treating device 10. When the latching pins 43 are retracted by pushing the button 41, the dust bin 30 may be removed from the compartment 24. When the dust bin 30 is in its fully installed/latched position, the handle 32 serves as a carrying handle for the robotic surface treating device 10.

Figure 7:
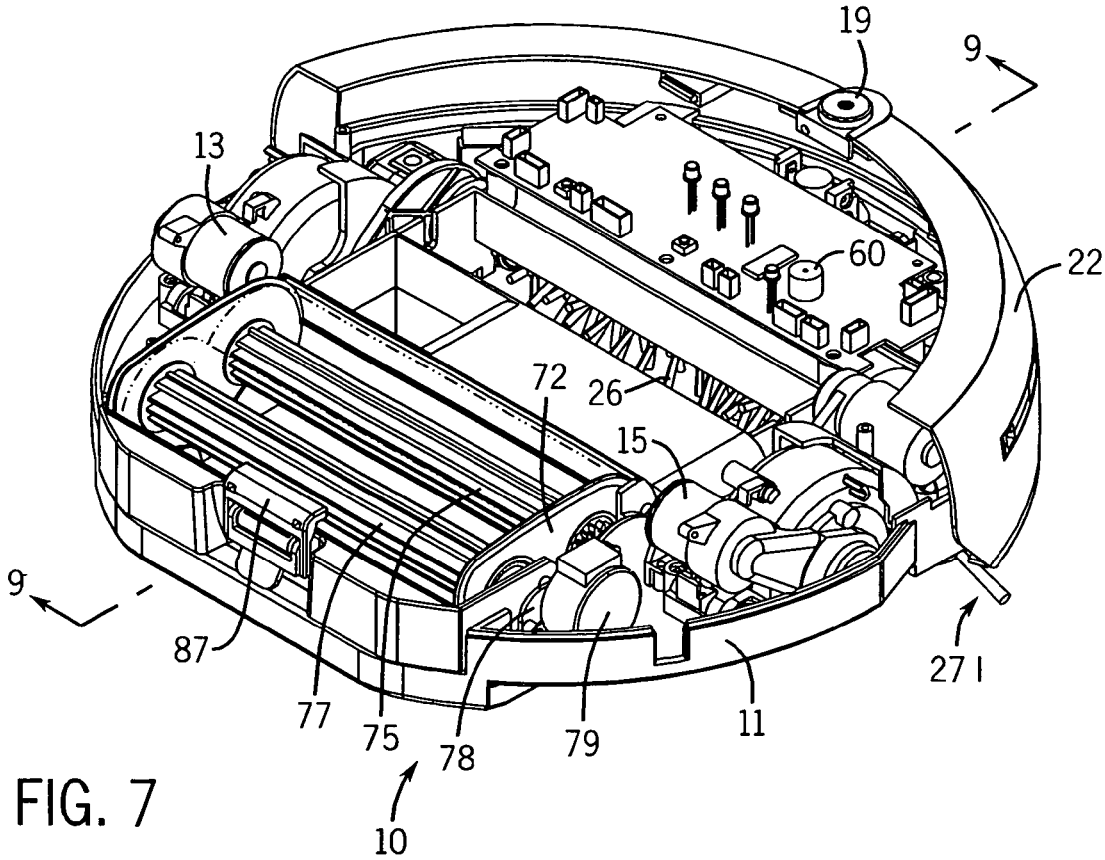
FIG. 7 is top, rear, left perspective view of the device of FIG. 1 with the device cover and the cleaning cloth and the cleaning cloth cartridge lid removed.
Figure 8:
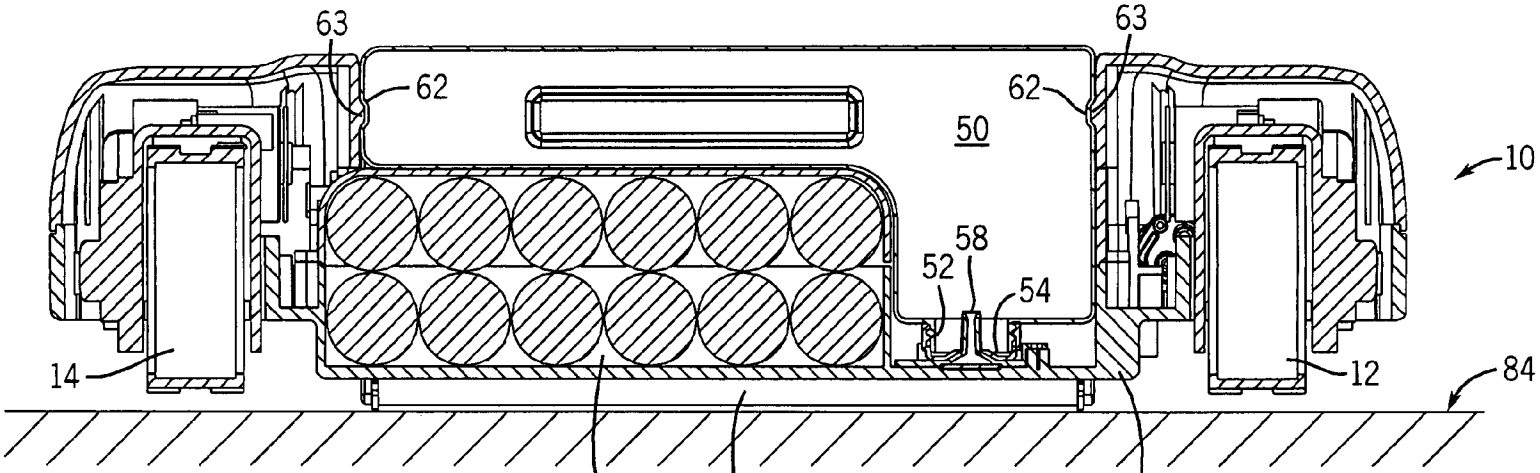
FIG. 8 is a sectional view taken along line 8-8 of FIG. 2.

Looking at FIGS. 6-8, the compartment 24 is also dimensioned for receiving a removable, replaceable fluid reservoir 50 rearward of the dust bin 30. The fluid reservoir 50 is part of the fluid delivery system of the robotic surface treating device 10. The fluid delivery system is used in conjunction with a cleaning cloth cartridge 70 (described below) to provide wet mopping. The fluid delivery system includes a pump 56 for periodically dispensing fluid (i) ahead of a sheet 74 of cleaning material of the cleaning cloth cartridge 70 on the surface being treated or (ii) on the sheet 74 of cleaning material or (iii) on the surface being treated and on the sheet 74 of cleaning material. The preferred location for the fluid reservoir 50 is at the center of the robotic surface treating device 10 to reduce weight variation. The fluid reservoir 50 is intended for multiple uses and remains in the robotic surface treating device 10 until used-up.

The controller drives the pump 56 to supply fluid from the fluid reservoir 50 to the surface being treated and/or on the sheet 74 of cleaning material as necessary during cleaning. In one embodiment, the controller provides fluid delivery signals to the pump 56 such that fluid is not delivered onto the surface to be treated or the sheet 74 of cleaning material when the rotation of the wheel as sensed by the encoders (mentioned above) is less than a predetermined amount. For example, the controller stops dispensing fluid from the pump 56 if the robotic surface treating device 10 becomes trapped—to avoid excess fluid deposition in a single spot.

The fluid reservoir 50 may comprise any of the following configurations: (i) a rigid, blow-molded bottle with a piercable cap/seal, (ii) a flexible pouch, or (ii) a permanent (non-removable) reservoir with a refill port. Looking at FIGS. 6 and 8, in the embodiment shown, the fluid reservoir 50 includes a sealing gasket, and a cap 52 with a piercable seal 54. A piercing post 58 in the housing pierces the seal 54 when the fluid reservoir 50 is installed in the compartment 24. Fluid may then flow through a conduit to the pump 56 which is in fluid communication with an elongated rectangular dispense manifold 65 (see FIG. 5) which delivers the fluid to the surface being treated and/or on the sheet 74 of cleaning material. The fluid in the fluid reservoir 50 preferably provides non-streak cleaning, rapid evaporation to avoid wheel slip, and biological stability to avoid odor, mold growth, etc. during storage of the robotic surface treating device 10 between uses.

The compartment 24 is also dimensioned for receiving a removable, replaceable cleaning cloth cartridge 70 rearward of the fluid reservoir 50. The cleaning cloth cartridge 70 is provided for floor wiping and fine particle pick-up. The cleaning cloth cartridge 70 includes an outer casing 71 that receives a frame 72 (see FIG. 3). A supply roller 75 and a take-up roller 77 are rotatably mounted on the frame 72 as shown in FIG. 7. The supply roller 75 supplies a sheet 74 of cleaning material that is reeled in by the take-up roller 77. A gear 78 on the end of the take-up roller 77 mates with a corresponding drive motor 79 on the robotic surface treating device 10. A catch 87 keeps the cleaning cloth cartridge 70 in the compartment 24. A cleaning cloth cartridge 70 may be used for multiple cleanings and then be replaced. The cleaning cloth cartridge 70 is easily removed and installed by the consumer from the top of the robotic surface treating device 10. The entire cleaning cloth cartridge 70 may be disposable.

The cleaning cloth cartridge materials are preferably designed for injection molding processes. Preferred materials are polypropylene and polyethylene or similar low cost resins, which are compatible with cleaning solutions. The sheet 74 can comprise, for example, an electrostatic or electret material. Examples of such materials are those described in WO 02/00819. A single cleaning sheet type may be used for both wet and dry cleaning. Additionally, alternate cleaning sheet types might be used including more absorbent, more abrasive, or more durable cleaning sheets. During operation, the sheet is continuously advanced to provide fresh cleaning sheet. The sheet advance may be controlled independent of the fluid dispensing. This flexibility allows for the optimization of the fluid/sheet ratios compared with standard wipes which start out too wet and end-up too dry. A lighter weight cleaning sheet (than would typically be used for a one time use wipe) could be employed allowing for less raw materials per cleaning occasion with equal or better results.

Preferably, the sheet 74 of cleaning material is kept at a constant tension and indexed at a rate of, for example, 0.75 inches per 5 minutes. Preferably, the index rate should remain constant over the life of the cleaning cloth cartridge 70, regardless of the size of the roll. An anti-reverse ratchet feature is provided to prevent used cloth from unreeling from the take-up roller 77 during use, storage, or disposal. Also, resistance is provided against the supply roller 75 to prevent uncontrolled dispensing of the sheet 74 of cleaning material during use or storage.

Looking at FIGS. 8 and 9, the cleaning cloth cartridge 70 includes a platen 81 that ensures contact between the sheet 74 of cleaning material and the floor 84. In one form, the width of the platen is approximately 1.25 inches. Some compliance is desirable in the platen 81 to allow for irregular surfaces and to ensure firm contact against the floor. This is provided by means of a D-shaped elastomeric extrusion 82 at the bottom of the platen 81.

The cleaning cloth cartridge 70 is intended to remain in the robotic surface treating device 10 until the sheet 74 of cleaning material is used-up. Spent cleaning cloth cartridges may be visually identified by the consumer by means of a transparent lid 86. The consumer can see the exposed sheet on the take up reel. Another method for use-up indication is to provide a printed stripe or marking at the end of the sheet 74 of cleaning material (similar to cash register machine tape use-up indication). In addition, an electronic use-up cue may be implemented (e.g. the robotic surface treating device 10 would sense high torque on the drive motor 79 and signal use-up by means of a tone or light).

The cleaning cloth cartridge 70 is intended to remain in the robotic surface treating device 10 for all cleaning operations such as carpet sweeping, dry hard floor sweeping, and wet mopping. At least three example methods are available to control contact of the sheet 74 of cleaning material with the surface being treated. In a first example method, the cleaning cloth cartridge 70 is allowed to float. The front of the cleaning cloth cartridge 70 is hinged by hinge pins 88 (see FIG. 3) to the inner wall of the compartment 24, while the back of the cleaning cloth cartridge 70 is allowed to swing up or down to accommodate variation in floor type or changes in level. In a second example method, the cleaning cloth cartridge 70 is manually set in one of two positions: (i) a down position that places the sheet 74 of cleaning material in contact with the surface being treated for hard surface cleaning, and (ii) an up position that lifts the sheet 74 of cleaning material away from the surface being treated for carpet cleaning. This may be achieved by providing separate mounting ledges for the hinge pins 88, that is, an upper set of mounting ledges and a lower set of mounting ledges. In a third example method, the cleaning cloth cartridge 70 position is actively adjusted by the robotic surface treating device 10. Automatic cartridge leveling allows the robotic surface treating device 10 to automatically move from room to room regardless of floor type and to navigate over area rugs on hard surfaces without becoming trapped. The appliance senses floor type and level changes by a sensor 94 (see FIG. 5) and lifts the cleaning cloth cartridge 70 as appropriate by way of mounting ledges that move up and down.

A method to control the dispense rate of the cleaning cloth cartridge 70 is also provided due to the fact that the take-up roller 77 and the supply roller 75 are continuously changing. A toothed wheel 90 (see FIG. 9) is provided inside the cleaning cloth cartridge 70. This wheel 90 is in contact with the sheet 74 of cleaning material and is rotated by the sheet 74 of cleaning material as the sheet advances. An optical sensor 92 adjacent to wheel 90, is used to detect rotation of the wheel 90. A change in rate of the rotation of the wheel 90 provides feedback through the controller and to the drive motor 79 to adjust its rate.

While an example cleaning cloth cartridge 70 has been described, alternative cleaning cloth systems are possible. For example, the casing 71 and frame 72 may be a durable/reusable component, while the empty supply roller 75 and the take-up roller 77 with used up sheet 74 of cleaning material may be disposable. The cleaning cloth cartridge 70 would be removed from the robotic surface treating device 10 for replacement of the rollers 75, 77. In another example configuration, the casing 71 and frame 72 would be eliminated. Disposable cloth reels would be loaded directly into the robotic surface treating device 10.

Thus, there is provided a robotic surface treating device where a dust bin, a fluid reservoir, and a reel-to-reel cartridge of cleaning material are each separately installable on the surface treating device and, once installed, the dust bin, fluid reservoir, and reel-to-reel cartridge of cleaning material may be separately replaced.

Although specific embodiments of the present invention have been described in detail, it should be understood that this description is merely for purposes of illustration. Many modifications and variations to the specific embodiments will be apparent to those skilled in the art, which will be within the scope of the invention. Therefore, the invention should not be limited to the described embodiments. Rather, the claims should be looked to in order to judge the full scope of the invention.

INDUSTRIAL APPLICABILITY

The invention provides a battery-operated autonomous robot that is intended for floor cleaning. The robot can perform carpet sweeping, hard-surface dry sweeping/wiping, and hard-surface sweeping/mopping.

What is claimed is:

1. A robotic surface treating device, comprising:

a dust bin;

a sheet of cleaning material;

means for moving the sheet of cleaning material relative to a surface to be treated; and a housing including a compartment having an open end for separately removably receiving the dust bin and the sheet of cleaning material;

wherein the means for moving the sheet of cleaning material comprises a first roller suitable for letting out a roll of the sheet of cleaning material, a second roller suitable for reeling in the sheet of cleaning material, and a motor to cause the sheet of cleaning material to transfer between the first roller and the second roller; and wherein the means for moving the sheet of cleaning material further comprises a sensor for monitoring the sheet cleaning material let out by the first roller and providing feedback to facilitate automatic adjustment of the rate at which the sheet is being transferred from roller to roller.

2. The robotic surface treating device of claim 1, wherein the open end of the compartment faces upward if the device is placed on a horizontal floor.

3. The robotic surface treating device of claim 1, further comprising a fluid delivery system including a fluid reservoir.

4. The robotic surface treating device of claim 3, wherein the open end of the compartment separately removably receives the fluid reservoir.

5. The robotic surface treating device of claim 3, wherein the fluid delivery system includes a pump for delivering fluid from the fluid reservoir onto the sheet of cleaning material and/or onto the surface to be treated.

6. The robotic surface treating device of claim 1, wherein the means for moving the sheet of cleaning material further comprises a cartridge for mounting the first roller and the second roller; and wherein the means for moving the sheet of cleaning material further comprises a window for viewing a position of the sheet of cleaning material in the cartridge.

7. The robotic surface treating device of claim 6, wherein the open end of the compartment separately removably receives the cartridge.

8. The robotic surface treating device of claim 6, wherein the means for moving the sheet of cleaning material further comprises a platen for pressing the sheet of cleaning material against the surface being treated.

9. The robotic surface treating device of claim 6, wherein the cartridge is pivotally connected to the housing at a first end of the cartridge such that a second opposite end of the cartridge can move up and down when encountering changes in elevation in the surface being treated.

10. The robotic surface treating device of claim 6, wherein the cartridge is connected to the housing such that the cartridge can be positioned in an up position or in a down position below the up position.

11. The robotic surface treating device of claim 1, wherein the dust bin includes a flexible blade provided adjacent the dust bin and directed toward the dust bin to direct dirt into the dust bin from a sweeper brush coupled to the housing.

12. The robotic surface treating device of claim 1, wherein the dust bin includes a spring loaded door that closes over an opening in the dust bin when the dust bin is removed from the housing.

13. The robotic surface treating device of claim 1, wherein the dust bin includes a handle and means for removably securing the dust bin to the housing whereby the device can be picked up by the handle when the dust bin is secured to the housing.

14. A robotic surface treating device, comprising:

a dust bin;

a sheet of cleaning material;

means for moving the sheet of cleaning material relative to a surface to be treated; and a housing including a compartment having an open end for separately removably receiving the dust bin and the sheet of cleaning material;

wherein the means for moving the sheet of cleaning material comprises a first roller suitable for letting out a roll of the sheet of cleaning material, a second roller suitable for reeling in the sheet of cleaning material, and a motor to cause the sheet of cleaning material to transfer between the first roller and the second roller;

wherein the means for moving the sheet of cleaning material further comprises a cartridge for mounting the first roller and the second roller;

wherein the cartridge is connected to the housing such that the cartridge can be positioned in an up position or in a down position below the up position; and wherein the means for moving the sheet of cleaning material further comprises a level sensor for sensing changes in elevation in the surface being treated and means for moving the cartridge into the up position or the down position in response to signals from the level sensor.

* * * * *